US009109865B2

(12) United States Patent
Haskins

(10) Patent No.: US 9,109,865 B2
(45) Date of Patent: Aug. 18, 2015

(54) CONTROLLABLE OUTPUT WARHEAD

(75) Inventor: Peter Haskins, Kemsing (GB)

(73) Assignee: QINETIQ LIMITED, FARNBOROUGH (GB)

( * ) Notice: Subject to any disclaimer, the term of this patent is extended or adjusted under 35 U.S.C. 154(b) by 0 days.

(21) Appl. No.: 13/695,457

(22) PCT Filed: Apr. 8, 2011

(86) PCT No.: PCT/GB2011/000542

§ 371 (c)(1), (2), (4) Date: Oct. 31, 2012

(87) PCT Pub. No.: WO2011/135279

PCT Pub. Date: Nov. 3, 2011

(65) Prior Publication Data

US 2013/0042782 A1 Feb. 21, 2013

(30) Foreign Application Priority Data

Apr. 27, 2010 (GB) ..... 1006957.3
Mar. 11, 2011 (GB) ..... 1104224.9

(51) Int. Cl.
*F42B 12/20* (2006.01)
*F42C 19/08* (2006.01)

(52) U.S. Cl.
CPC ..... *F42B 12/207* (2013.01); *F42B 12/208* (2013.01); *F42C 19/0842* (2013.01); *F42C 19/0846* (2013.01); *F42B 12/20* (2013.01); *F42C 19/08* (2013.01)

(58) Field of Classification Search
CPC ..... F42B 12/20; F42B 12/207; F42B 12/208; F42C 19/08; F42C 19/0838; F42C 19/0842; F42C 19/0846
USPC ..... 102/473, 478, 481, 491, 492, 493, 494, 102/495, 496, 497
See application file for complete search history.

(56) References Cited

U.S. PATENT DOCUMENTS 3,960,085 A 6/1976 Abernathy et al.
4,655,139 A * 4/1987 Wilhelm ..... 102/494

(Continued)

FOREIGN PATENT DOCUMENTS

EP 2233879 9/2010
WO WO 2008/097241 8/2008
WO WO 2009/1515363 12/2009

OTHER PUBLICATIONS

International Search Report for PCT/GB2011/000542 mailed Jul. 28, 2011.

(Continued)

*Primary Examiner* — James S Bergin
(74) *Attorney, Agent, or Firm* — Nixon & Vanderhye P.C.

(57) ABSTRACT

This invention relates to a novel munition (1) comprising a controllable output warhead and also munitions comprising one or more of said warheads. There are further provided methods of preparing the warheads of the invention, methods of controllably detonating the warheads and a kit suitable for preparing such a warhead. The warhead comprises an inner and outer portion of high explosive (3, 4) co-axially located and separated by a non-detonative material (5), such that in use at least two output modes are possible, by either simultaneous detonation of both the inner and outer portion high explosives (3, 4) or selective detonation of the inner high explosive portion (3).

5 Claims, 3 Drawing Sheets

(56) References Cited

U.S. PATENT DOCUMENTS

| | | | | |
|---|---|---|---|---|
| 5,054,399 | A * | 10/1991 | Bilek et al. | 102/481 |
| 5,233,929 | A * | 8/1993 | Spahn | 102/475 |
| 5,544,589 | A | 8/1996 | Held | |
| 6,283,036 | B1 * | 9/2001 | Munsinger | 102/479 |
| 7,347,906 | B1 * | 3/2008 | Guirguis | 149/14 |
| 7,845,282 | B2 * | 12/2010 | Sheridan et al. | 102/473 |
| 8,033,223 | B2 * | 10/2011 | Sheridan et al. | 102/473 |
| 8,250,986 | B1 * | 8/2012 | Sheridan et al. | 102/499 |
| 8,256,350 | B2 * | 9/2012 | Haskins | 102/478 |
| 8,387,539 | B1 * | 3/2013 | Maines | 102/493 |
| 2004/0011238 | A1 | 1/2004 | Ronn et al. | |

OTHER PUBLICATIONS

N. Gibson, "A Weapon for All Occasion? Dial-a-Yield Concepts Hold Out Promise of Flexibility", Jane's International Defence Review, vol. 41, No. 7, Jul. 2008, pp. 28-29.

* cited by examiner

CONTROLLABLE OUTPUT WARHEAD

This application is the U.S. national phase of International Application No. PCT/GB2011/000542 filed 8 Apr. 2011 which designated the U.S. and claims priority to GB 1006957.3 filed 27 Apr. 2010, and GB 1104224.9 filed 11 Mar. 2011, the entire contents of each of which are hereby incorporated by reference.

This invention relates to warheads, and munitions comprising one or more warheads. In particular, the invention lies in the field of controllable warheads, especially those capable of providing a selectable output. The warhead may also find particular use in increasing the IM compliance of munitions. There are further provided methods of preparing the warheads of the invention, methods of controllably detonating the warheads and a kit suitable for preparing such a warhead.

There is a requirement to provide warheads with a selectable or tuneable output such that the properties of the payload may be selected to achieve the desired effect for the type of target, without having to resort to transporting a variety of separate bespoke munitions for each situation.

By the term "munition" as used herein is meant any casing that carries a high explosive material in the form of a warhead. The munition may also comprise other components that are used to deliver said warhead, such as bombs, rockets, or any similar device.

According to a first aspect of the invention, there is provided a variable output warhead comprising at least two high explosive portions, comprising a inner high explosive portion about which is co-axially located an outer high explosive portion, wherein the inner and outer high explosive portions are separated by a non-detonative material that is capable of preventing sympathetic detonation between said portions, and wherein the inner and outer high explosive portions are each provided with a means of detonation, such that in use each portion may be detonated independently to control the explosive output. The controlled detonation will determine the effect and severity of the explosive output.

In order to provide further selectivity or control over the output from the warhead, there may be provided at least one further high explosive portion, each at least one further high explosive portion being provided with a means of detonation, and each at least one further high explosive portion being co-axially located between the inner and outer high explosive portions, wherein each said further high explosive portion is separated from adjacent high explosive portions by a further portion of the non-detonative material.

By the term separated is meant that the individual portions of high explosive material are located apart from each other such that detonation in one of the high explosive portions does not readily propagate to the neighbouring high explosive portion.

Preferably, the separation is such that the individual high explosive portions are not in intimate contact with, i.e. are not abutting, neighbouring high explosive portions. The separation is provided by the non-detonative material as defined herein. The separation may be provided by one or more layers of the non-detonative material, which may cover part, substantially all or the entire surface of the individual high explosive portions.

The non-detonative material may be any material that is itself not capable of sustaining detonation; otherwise the high explosive portions and the non-detonative material may all detonate simultaneously (i.e. sympathetic detonation may occur) and hence, selectivity or control in the output will not be provided. The non-detonative material may be selected from a material other than a high explosive material, i.e. one that is not capable of sustaining or transferring a detonation reaction. The non-detonative material may comprise inert materials such as polymers and/or rubbers, or it may comprise high energy materials that enhance the blast, provided such high energy materials are not themselves capable of sustaining detonation. In theory the non-detonative material may be an air gap, but in practice this would give rise to movement of the individual high explosive portions, which may in turn cause breakage. Thus, any air gap is ideally supported, to prevent movement of the high explosive portions, because the high explosive material needs to survive transport and handling regimes during its lifetime. Preferably, the non-detonative material is an energetic non-detonative material, such that the non-detonative material comprises a high energy material such as an energetic material (i.e. combustible material), or powdered metal, particularly metal loaded polymers, and yet more preferably reactive metals, such as aluminium, preferably in a binder.

Alternative energetic systems are energetic polymer binder materials. The energetic polymer binder may, for example, be selected from Polyglyn (Glycidyl nitrate polymer), GAP (Glycidyl azide polymer) or Polynimmo (3-nitratomethyl-3-methyloxetane polymer).

There are many known additives for binders and explosive formulations that are used to enhance the output performance of a warhead. Advantageously, the non-detonative material may comprise a high energy material so as to compensate for the reduction in the total volume/mass of high explosive missing (in other words, the material that would have occupied the separation between abutting high explosive portions in the warhead of the munition). The use of aluminium particles to enhance blast is well known and is a highly preferred additive.

The high explosive portions may be made from any high explosive material. By high explosive is meant a material which is capable of sustaining detonation when it is impacted upon by a detonative impulse. It is not desirable to choose initiatory compounds (such as, for example, azides), or compounds that are capable of building up to detonation from a deflagration or burning event.

Typically, the high explosive will be based upon a standard high (secondary) explosive compound, such as, for example, RDX, HMX, NTO, TATB. Preferably, the explosive may be a composition and may be a cast cured PBX i.e. a high explosive in a polymer binder, such as, for example, RDX/HTPB. The high explosive composition may itself contain blast enhancing materials, such as, for example, reactive metal powders, such as, for example, aluminium. Preferably, the outer high explosive portion is aluminised, such that in the lower mode (when only the inner high explosive portion is detonated) the aluminium in the outer high explosive portion will still burn, thereby helping to increase the quasi static pressure, as defined further below.

In an alternative embodiment, the outer high explosive portion has a dimension which is below its critical detonation diameter, such that it may only sustain detonation when it is detonated substantially simultaneously with the inner high explosive portion or the at least one further high explosive portions, when present.

This provides a further advantage that the outer high explosive portion cannot itself sympathetically detonate when only the inner or at least one further explosive portions, if present, is detonated. Therefore, the outer high explosive portion can only sustain detonation when it is detonated simultaneously with the inner portion. A yet further advantage is that the risk of unwanted detonation of the entire munition from a hazard attack, such as, for example, a fragment or bullet, is also reduced because the outer high explosive portion is itself not capable of sustaining detonation. The critical detonation cross section (critical diameter) for a high explosive is the minimum cross section of that explosive that can be detonated in a direction normal to the cross section in the absence of any confinement. In other words, it is the minimum physical cross section of a specific explosive that must be present in order to sustain its own detonation wave. Typically, munitions are built with cylindrical charges and so the term critical diameter is routinely used. Clearly, however, any cross section shape of high explosive may be used, and so there will be a minimum i.e. critical detonation cross section that is required in order for a particular explosive to sustain its own detonation wave. The effective critical detonation cross section is reduced if the explosive is heavily confined, so this will need to be taken into account when the charge is located inside a munition. The reduction in effective critical detonation cross section would be readily calculated by those skilled in the art. The measurement of the critical detonation cross section of any given high explosive may be determined by routine experimentation, to provide a precise and reproducible value, in a given batch of explosive.

In a further embodiment, the inner high explosive portion may be a warhead comprising at least two portions of high explosive separated by a non-detonative material, wherein each portion has a cross section below its critical detonation cross section, and wherein the at least two portions are arranged such that the total cross section of the at least two portions exceeds the critical detonation cross section of said high explosive, such that in use only simultaneous initiation of the at least two high explosive charges causes detonation of the warhead to occur; as defined in EP 2233879.

A yet further means of mitigating against hazard attack may be to provide a layer of the non-detonative material such that it is further enveloped around the outside of the outer high explosive portion. In order to provide a further barrier between an incoming fragment, bullet, shockwave or the like and the portions of high explosive, a further portion of the non-detonative material may be enveloped around the outer perimeter of the outer high explosive portion. Thus, the entire outer surface of the outer high explosive portion may be covered with the non-detonative material.

According to a further aspect of the invention, there is provided a munition comprising at least one warhead according to the invention.

The warhead according to the invention is designed to provide at least two different output terminal effect modes, the exact number of which will depend on the number of further high explosive portions that are available in the warhead. The terminal effect modes may be pre-selected depending on the type of target, i.e. open target, such as, for example, battlefield, or a confined target, such as, for example, a building or structure. The use of a high peak pressure device in a confined space may cause undesirable damage to neighbouring structures.

Therefore, the terminal effect modes are more than just different levels of performance or damage caused by the detonation of the warhead. It is possible to tune the warhead to cause the desired level of effect to the target that is selected. If there are only two high explosive portions then there are envisaged to be two different terminal effect modes; a low order mode and a high order mode.

The low order mode is designed to minimise the peak pressure and minimise fragmentation. However it is designed to provide a high quasi static pressure (QSP). In the low order mode only the inner high explosive portion will be detonated. The non-detonative material will provide sufficient shock attenuation to prevent detonation of the outer high explosive portion. However, the non-detonative material and the outer high explosive portion will be ignited and dispersed, by the sole action of the detonation of the inner high explosive portion, leading to a large after-burn and a high QSP, particularly in a closed environment.

One advantage of using co-axially located high explosive portions is that there is no requirement to ignite the outer explosive portion or the non-detonative material by the use of a dedicated separate igniter, because substantially all of the outer high explosive portion will be in close proximity to substantially all of the inner high explosive portion, such that ignition of the outer high explosive portion is achieved.

The QSP induced in a poorly vented structure is determined by both the detonation event and the subsequent, considerably slower, burning reactions. Whilst the detonation products from many high explosives will continue to burn in the presence of atmospheric oxygen, thus contributing to the QSP, the heat of reaction of additives such as aluminium is considerably greater. The QSP may therefore be further enhanced by the use of an outer portion of high explosive and/or non-detonative material that are metal filled, particularly ones which are aluminised. This low order mode is desirable for effects were minimum collateral damage is required.

To facilitate the fast burn/deflagration reaction of the outer high explosive layer and non-detonative material in the low order (high QSP) mode, the munition may have at least part of its casing weakened. This will allow the case to rupture easily, thereby ensuring good dispersion of the reactive materials, and will also minimise the danger from fragmentation.

The high order mode is designed to provide a higher peak pressure and increased fragmentation, which may be suitable for open battlefield attack. This high order mode requires that the inner and outer high explosive portions, and the at least one further high explosive portions therein, are detonated substantially simultaneously. In the high order mode the detonation of all high explosive portions will lead to a higher peak pressure and fragment velocities than in the low order mode.

According to a further aspect of the invention, there is a provided a method of selectively detonating a munition according to the invention for producing a low collateral damage high quasi static pressure warhead, comprising the steps of detonating the inner high explosive portion.

According to a yet further aspect of the invention, there is provided a method of selectively detonating a munition according to the invention for producing a high collateral damage and high peak pressure warhead, comprising the steps of substantially simultaneously detonating the inner and outer high explosive portions and the at least one further high explosive portions, when present.

There are many available means to ensure that two or more detonation waves arrive at two separate locations substantially simultaneously. By substantially simultaneously is meant that the detonative shockwave is applied to all of the high explosive portions within a less than 20 microsecond timescale, more preferably within a less than 10 microsecond timescale, yet more preferably within a less than 5 microsecond timescale, so as to ensure that the detonation waves from adjacent of high explosive portions are able to produce a combined effect.

In order to provide a series of detonative pulses that are closely timed, a high voltage system such as, for example, a plurality of individual exploding foil initiators (EFI) or exploding bridgewires (EBW) may be used. Other forms of driven flyer plate may also be used, or laser initiation. The selection of high order or low order may then simply be the electrical activation of only one or two detonation means (or further detonation means if further high explosive portions are present), such that the desired output is achieved. It may be desirable, especially for large diameter munitions, to provide more than a single point of detonation means to the outer high explosive portion.

Lower specification munitions may not possess expensive high voltage systems, so in an alternative arrangement a single detonative pulse may be promulgated via a plurality of explosive track plates, or detonation cords, so as to ensure that the single detonative pulse reaches all of the high explosive portions substantially simultaneously. This degree of accuracy is vital so as to ensure that in the high order mode all of the high explosive portions are detonated at substantially the same time, thereby preventing disruption of one or more portions and providing the maximum peak pressure. In a high order mode all of the above detonation transfer means will be substantially simultaneously detonated.

In order to effect a low order reaction, an inhibitor or interrupter, such that which may form part of an onboard safety and arming unit (SAU), may be required to prevent the transmission of a detonation wave to the outer high explosive portion, such that detonation only proceeds to the inner high explosive portion.

Certain lower cost munitions may not be capable of having their outputs changed during flight, and therefore it may be desirable that the munition is ready in a low order mode, and the munition is required to be primed to produce a high order mode if so desired.

There is further provided the use of a warhead according to the invention in a munition to selectively control the output of a munition.

There is no limit, in theory, to the number of different co-axially arranged high explosive portions. However, in practice too many portions will make fabrication of the warhead difficult and hence, excessive numbers of high explosive portions are undesirable. Preferably, the portions of high explosive are elongate, so as to increase the total explosive mass available in the warhead.

The inner and outer high explosive portions may be selected from the same or different high explosive material. Preferably, the outer high explosive portion is metal filled, more preferably aluminised.

The warhead may be made up of a plurality of discrete high explosive portions, which are each, in turn, enveloped by the non-detonative material. These enveloped portions of high explosives may be loaded sequentially into the munition individually, or preassembled as a complete unit to provide the final warhead.

According to a further aspect of the invention, there is provided a method of preparing a warhead according to the invention comprising the step of providing an inner high explosive portion, enveloping said inner high explosive portion with a non-detonative material, and co-axially arranging the outer high explosive portion around said non-detonative material.

In an alternative arrangement, especially suitable for castable high explosive formulations, it may be desirable to preform a wall, matrix or lattice of non-detonative material which can be filled with the melt or cure cast high explosive, to form the respective inner and outer high explosive portions and at least one further high explosive portions when present therein. Accordingly, there is provided a method of preparing a warhead according to the invention comprising the step of providing at least two voids formed by at least one wall of a non-detonative material, wherein at least one void accommodates the inner high explosive portion and at least one void accommodates the outer high explosive portion, and filling said voids with high explosive. In addition, more complex shapes other than cylindrical may be prepared.

The matrix, lattice or wall of non-detonative material may be located in the munition prior to filling with the castable explosive formulation, or it may be gently lowered into a munition that has just been filled with said castable formulation. Alternatively, the matrix, lattice or wall of non-detonative material may be filled with said explosive and then inserted into a munition.

According to a yet further aspect of the invention, there is provided a kit of parts comprising at least two high explosive portions separated by a non-detonative material, wherein said inner and outer high explosive portions and said non-detonative material are capable of being arranged in a coaxial arrangement, and a means of detonation of each of the plurality of said portions of high explosive.

Any feature in one aspect of the invention may be applied to any other aspects of the invention, in any appropriate combination. In particular, device aspects may be applied to method and use aspects, and vice versa.

Embodiments of the invention are described below by way of example only and with reference to the accompanying drawings in which.

Figure 1:
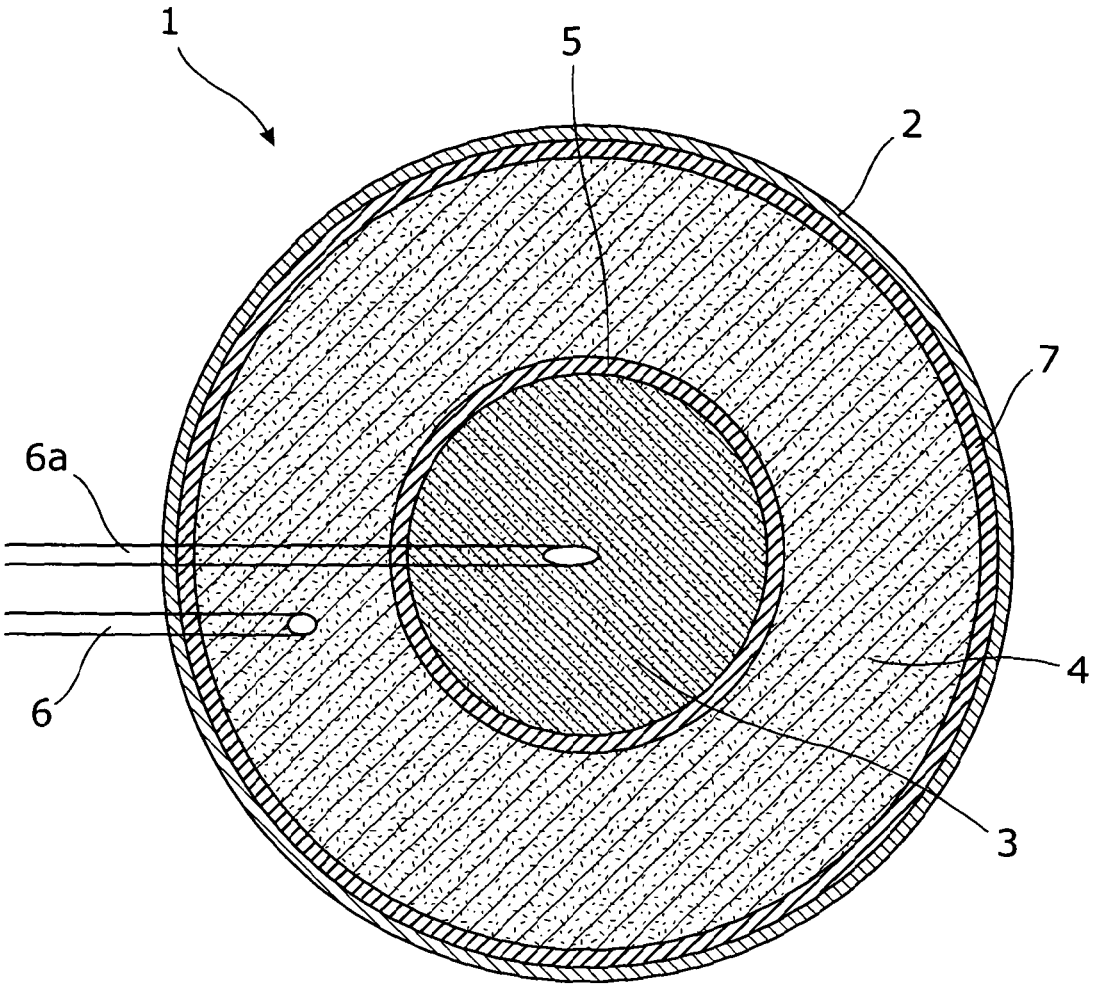
FIG. 1 shows a cross section of a cylindrical warhead in a munition casing of the invention.

FIG. 1 shows a cross sectional view of a munition 1 which possesses a case 2. The inner high explosive portion 3 is enveloped by a non-detonative material 5, such that the inner high explosive portion 3 is not in intimate contact with the outer high explosive portion 4. In one embodiment of the invention, there may be an additional layer of non detonative material 7 between the case 2 and the outer higher explosive portion 4. There is provided a means of detonation 6, for the outer high explosive portion 4, and a detonation means **6*a* for the inner higher explosive portion 3. For larger munitions there may be more than one means of detonation 6**, to facilitate detonation.

Figure 2:
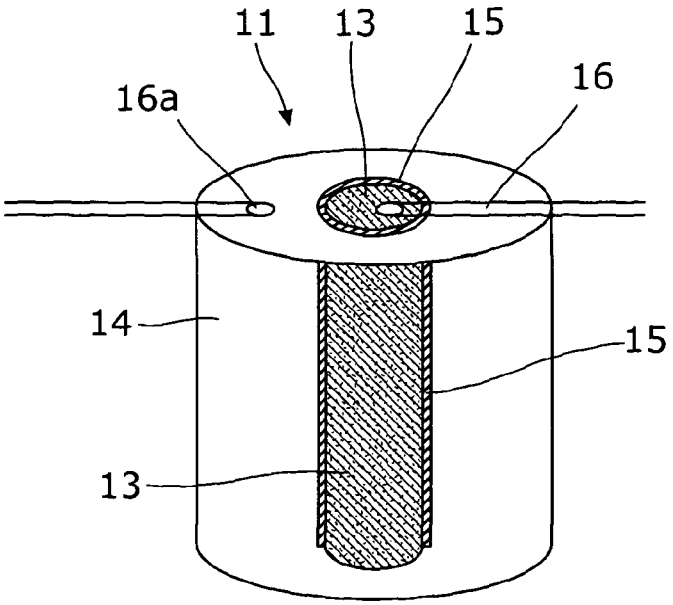
FIG. 2 shows a side elevation of a series of cylindrical charges for a warhead.

FIG. 2 shows a side view of a warhead charge 11, without a case, comprising an inner high explosive portion 13 enveloped by a non-detonative material 15, such that the inner high explosive portion 13 is not in intimate contact with the outer high explosive portion 14.

On the top face of the inner high explosive portion 13, there is located a means of detonation 16, and on the top face of the outer high explosive portion 14, there is located a detonation means **16*a*. The detonation means 16 and 16*a* are capable of being selected to either i) both undergo substantially simultaneous detonation or ii) be selectively detonated, such that only detonation means 16 causes the inner high explosive portion 13 to detonate. The warhead charge 11 may be inserted into a munition casing as shown in FIG. 1**.

Figure 3:
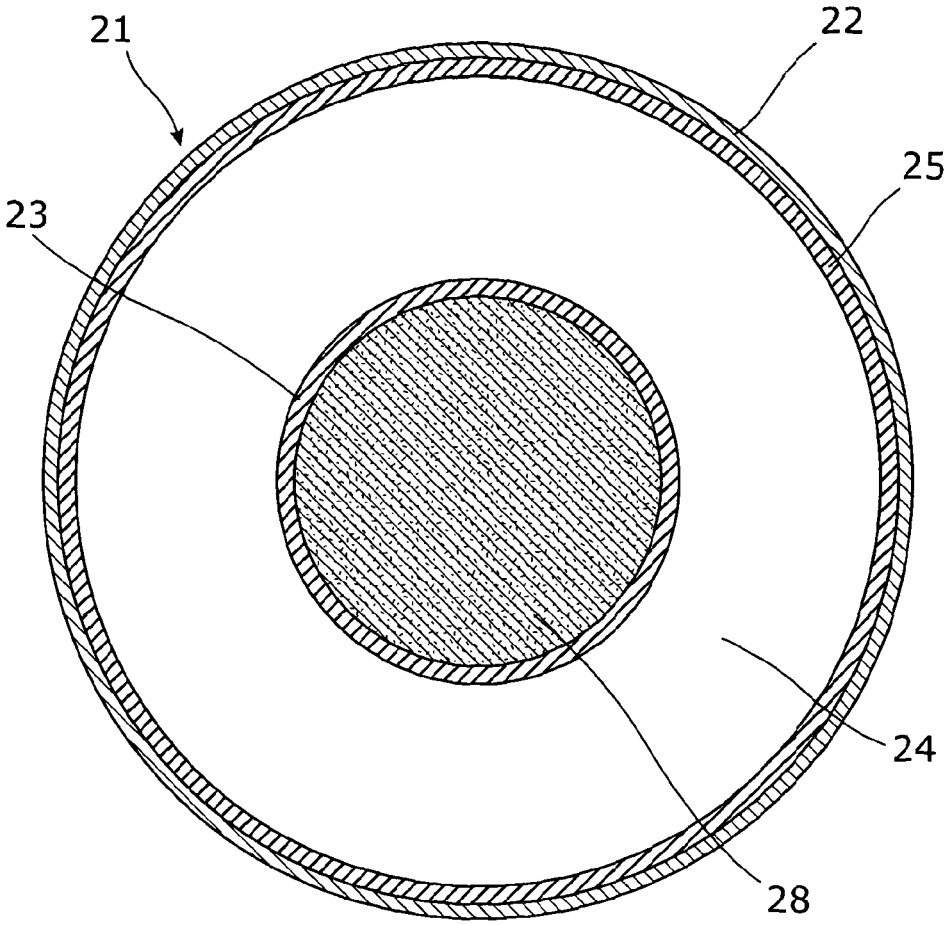
FIG. 3 shows a top view of a munition with predetermined inner and outer arranged voids ready for melt cast high explosives.

FIG. 3 shows a top view of a partially filled munition 21 which possess a case 22 having a wall of non-detonative material 23 which defines an outer void 24 and an inner void. The inner void is shown as filled with explosive 28. Conveniently, there may be a further band of non-detonative material 25 located between the outer void 24 (which may be filled with high explosive) and the munition case 22.

The munition 21 may be formed by locating non-detonative material walls 25 and 23 into the casing 22, and then filling the voids 24 and 28 (the latter being shown already filled) with high explosive composition, allowing different high explosive portions to be used. An example is a standard high explosive for the inner portion 28 and an aluminised portion in the void 24. Alternatively, the arrangement in FIG. 2 (no-case) may be directly inserted into a case such as case 22 in FIG. 3, with an optional non-detonative material layer 25.

EXAMPLES

A variable output warhead (or charge) was designed based upon a fill consisting of three components, namely:

An inner high performance high explosive composition (specifically PBXN-110 (88% HMX, 12% HTPB)), A reactive, but non-detonative composition (specifically QRX 263 (80% by weight spherical aluminium powder (10.5 μm) in a cured HTPB binder system)), and An outer highly aluminised explosive composition (specifically QRX 104 (53% RDX, 35% Al (10.5 μm spherical), 12% HTPB/DOS/IPDI binder)).

The cylindrical high performance explosive was surrounded by a concentric jacket of the reactive, but non-detonative, composition. The jacket was in turn surrounded by a further concentric layer of the aluminised explosive.

In a first design mode, only the high performance explosive was initiated by a fuse train, the reactive jacket being chosen to provide sufficient shock attenuation to prevent detonation of the aluminised PBX. However, the reactive jacket and aluminised explosive were ignited and dispersed, leading to a large after-burn and high QSP in a closed environment.

In the second design mode, both explosive compositions (i.e. the inner high performance high explosive and the outer aluminised explosive) were initiated by a fuse train. This led to a higher peak pressure and fragment velocities than in the first design mode.

Thickness of Non-Detonative Material (Attenuator) Layer

Before testing the warhead designs, the thickness of the QRX 263 attenuating layer required to prevent detonation of the outer QRX 104 explosive when the inner PBXN-110 charge was detonated was established. To accomplish this, cylindrical pellets of QRX 104 (mean weight 22.5 g) and PBXN-110 (mean weight 20.5 g) were manufactured. These charges were used in a 'Gap Test' arrangement with a varying thickness attenuator layer and a 5 mm thick aluminium witness plate to establish whether or not initiation take-over had occurred. The results of these tests are summarised below in Table 1.

TABLE 1

Summary of take-over tests

| Test No. | Attenuator thickness (mm) | Donor (PBXN-110) mass (g) | Results |
|---|---|---|---|
| 1 | 0 | 20.5 | Clean hole through witness plate. |
| 2 | 10 | 20.5 | Clean hole through witness plate. |
| 3 | 20 | 20.5 | Bent witness plate |
| 4 | 15 | 20.5 | Bent witness plate |
| 5 | 15 | 41 | Severely bent witness plate |

These tests clearly show that take-over did not occur if the attenuating layer was 15 mm or greater in thickness. In the last test (Test 5) two pellets of PBXN-110 were used for the donor charge to provide added confidence that 15 mm of attenuator would be sufficient to prevent take-over. Based on these results, the variable output warhead design was based on a 15 mm QRX 263 attenuation layer.

Charge Design and Manufacture

Figure 4:
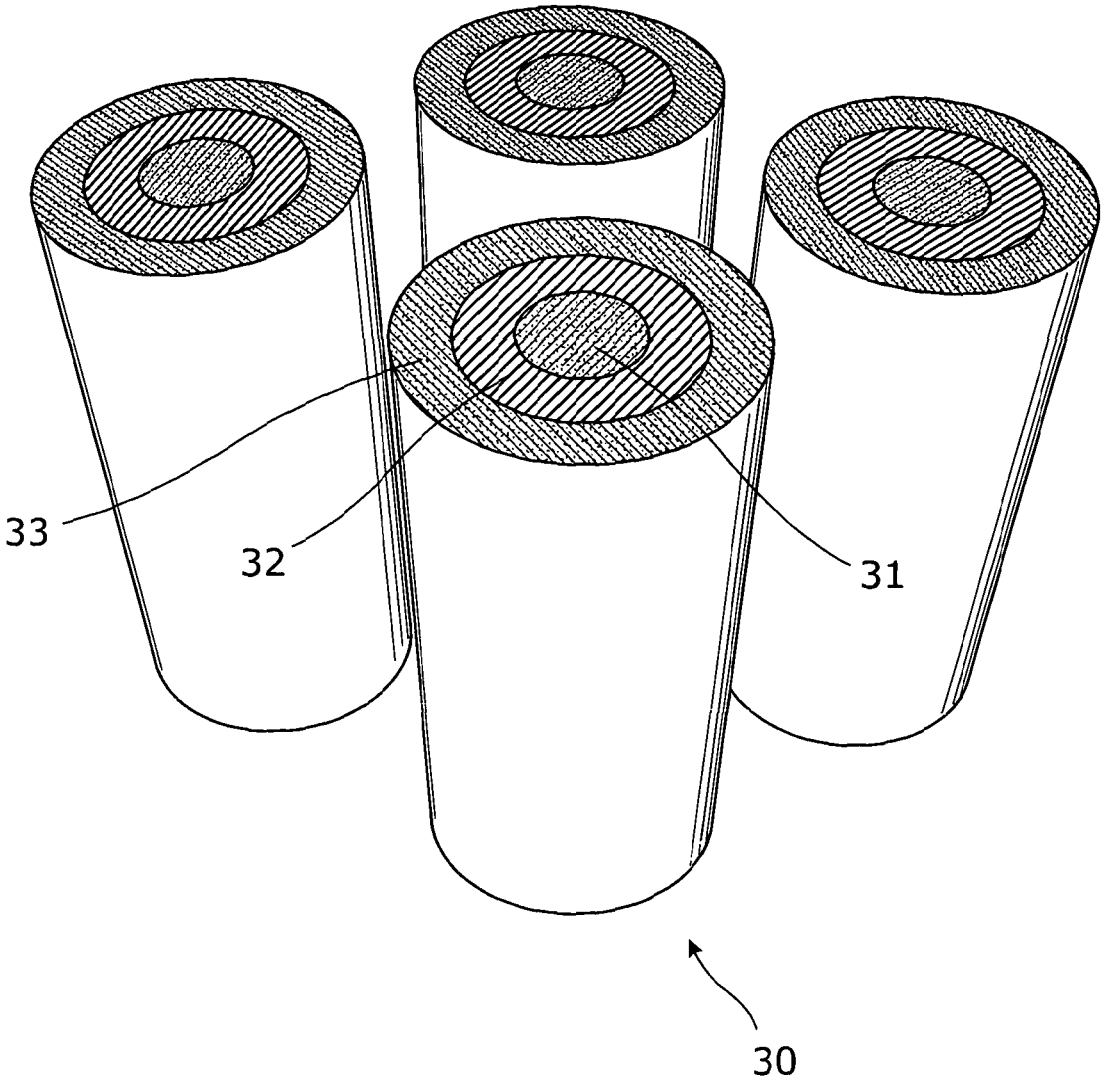
FIG. 4 shows the four charges of Tests 6 to 9.

Four prototype charges were manufactured using standard casting and curing processes. Each charge had PBXN 110 as the central core charge at a diameter of 35 mm. This was surrounded by QRX 263 in a 15 mm thick layer, with QRX 104 as the outer layer (again at a thickness of 15 mm). The charges were 195 mm long and each had a total mass of about 2.6 kg. The charges are shown in FIG. 4. Each charge 30 comprises a high performance high explosive 31, a reactive, but non-detonative, composition 32 and a layer of aluminised explosive 33.

Testing

The four charges were tested in a firing cell, with QSP and incident pressure gauges (two gauges at 1 m and one gauge at 1.5 m). The charges were all suspended in the centre of the chamber in line with the pressure gauges. The tests are described in detail below.

Test 6:

This firing was designed to test the charge in the second design mode, when both explosive components are detonated. Initiation was conducted by placing two 3 mm thick disks of SX2 sheet explosive over the whole of the top of the charge. The SX2 (76 g) was initiated by a 2 g Tetryl pellet and an EBW detonator.

The peak incident pressure and QSP measurements for Test 6 (and the subsequent three tests) are shown in Table 2.

TABLE 2

Incident pressure and QSP measurements for Tests 6-9

| Test No. | Incident pressure (1 m) | Incident pressure (1 m) | Incident pressure (1.5 m) | QSP (kPa) |
|---|---|---|---|---|
| 6 | 2638 | 2644 | 1234 | 480 |
| 7 | 1736 | 1812 | 927 | 447 |
| 8 | 1630 | 1094 | 928 | 450 |
| 9 | 2638 | 2545 | 1185 | 520 |

Test 7:

Test firing 2 was designed to test the charge in the first design mode, when only the central charge of PBX N110 is initiated directly. Initiation was by means of 76 g of SX2 (the same mass as for Test 6) in the form of a stack of fifteen 3 mm thick disks placed over the central core charge only. The SX2 was again initiated by a 2 g Tetryl pellet and an EBW detonator.

It can be seen from Table 2 that the incident pressures obtained from this firing are significantly lower than those from the first test, although the QSP value is only slightly less. This would appear to be consistent with detonation of the PBX N110 only in this test, but with reasonably complete combustion of the QRX 104 contributing to a similar QSP value to the first firing.

Test 8:

Test 8 was a repeat of Test 7, except that the central PBX N110 core was initiated by a 2 g Tetryl pellet and EBW detonator only. To ensure direct comparison with the previous tests, 76 g of SX2 was attached to the base of the charge (opposite end from initiation), covering the central charge only.

With the exception of one of the incident pressure gauges at 1 m, which gave an anomalous low reading, the incident pressures and QSP were very similar to those obtained in Test 7.

Test 9:

Although it appeared that both explosive charges (PBX N110 and QRX 104) had detonated in Test 6, there was nevertheless a possibility that the QRX 104 had failed to detonate fully (because the thickness of the QRX 104 layer (15 mm) was slightly less than the critical diameter for this explosive—known from previous work to lie between 15.5 and 18.9 mm for a bare cylindrical stick). Hence, in Test 9 the outside of the charge was wrapped with a layer of SX2 to ensure full detonation of the QRX 104. Initiation was as for Test 6 with two 3 mm thick disks of SX2 covering the entire top of the charge. The external wrapping of SX2 added an additional 491 g of explosive.

The gauge data from Test 9 (Table 2) show a slight increase in QSP, but very similar incident pressures to Test 6. It can be concluded that the only difference is due to the detonation of an additional 491 g of SX2.

In summary, incident pressure data recorded in firing tests show that the variable output warhead according to the invention is performing in the intended dual mode.

Comparative Example

Two 2 kg PE4 gauge test firings were also carried out (Tests 10 and 11) as a comparison with the tuneable warhead firings. Table 3 shows the pressure data for the 2 kg PE4 tests.

TABLE 3

Incident pressure and QSP measurements from 2 kg PE4 tests

| Test No. | Incident pressure (1 m) | Incident pressure (1 m) | Incident pressure (1.5 m) | QSP (kPa) |
|---|---|---|---|---|
| 10 | 1859 | 2645 | 1321 | 277 |
| 11 | 2638 | 2649 | 1194 | 281 |

It can be seen that the incident pressures from 2 kg of PE4 are similar to those from the tuneable warhead charges—with the exception of one anomalous low reading at 1 m—when initiated in the second design mode (i.e. both explosives initiated, as in Tests 6 and 9). However, the QSP from the PE4 charges is very much lower than that measured in all the tuneable warhead tests. This indicates a substantial contribution to the QSP from the aluminium (in both the QRX 104 and QRX 263).

The invention claimed is:

1. A variable output warhead comprising at least two high explosive portions, comprising a inner high explosive portion about which is co-axially located an outer high explosive portion, wherein the inner and outer high explosive portions are separated by a non-detonative material that is capable of preventing sympathetic detonation between said portions, wherein the inner and outer high explosive portions are each provided with a means of detonation, such that in use each portion may be detonated independently to control the explosive output and wherein the outer high explosive portion has a dimension which is below its critical detonation diameter, such that it may only detonate when the inner high explosive portion is detonated.

2. A warhead according to claim 1, wherein the outer high explosive portion is an aluminised high explosive.

3. A warhead according to claim 1, wherein the non-detonative material is an energetic non-detonative material.

4. A warhead according to claim 3, wherein the energetic non-detonative material is a metal loaded polymer.

5. A warhead according to claim 4 wherein the metal loaded polymer is an aluminised polymer.

* * * * *